US006962126B1

(12) United States Patent
Payson

(10) Patent No.: US 6,962,126 B1
(45) Date of Patent: Nov. 8, 2005

(54) AUTOMATIC RISING CAUTION FLAG

(76) Inventor: Harland Perry Payson, 2955 Palisades Dr., Lake Havasu City, AZ (US) 86404

( * ) Notice: Subject to any disclaimer, the term of this patent is extended or adjusted under 35 U.S.C. 154(b) by 0 days.

(21) Appl. No.: 10/845,561

(22) Filed: May 13, 2004

(51) Int. Cl.[7] ..... G08C 5/00; G09F 17/00

(52) U.S. Cl. ..... 116/303; 116/173; 114/253; 340/573.6

(58) Field of Search ..... 33/303, 173, 174, 33/175, 284, 285, 294, 305; 114/253; 340/984, 340/985, 573.6

(56) References Cited

U.S. PATENT DOCUMENTS

| | | | | |
|---|---|---|---|---|
| 2,557,859 | A * | 6/1951 | Bernstein | 116/173 |
| 3,021,513 | A * | 2/1962 | Lankey | 340/286.02 |
| 3,786,778 | A | 1/1974 | Palmer et al. | |
| 3,798,631 | A * | 3/1974 | Langford | 340/502 |
| 3,848,244 | A | 11/1974 | Young et al. | 340/665 |
| 4,090,468 | A * | 5/1978 | D'Spain | 116/267 |
| D255,226 | S | 6/1980 | Daniels | |
| 4,640,213 | A * | 2/1987 | Lugo | 114/253 |
| 4,747,085 | A * | 5/1988 | Dunegan et al. | 367/93 |
| 4,782,784 | A | 11/1988 | Little | 116/303 |
| 4,934,972 | A * | 6/1990 | Shumway et al. | 441/69 |
| 4,962,720 | A | 10/1990 | Leffel | |
| 5,408,221 | A * | 4/1995 | Carsella et al. | 340/604 |
| 5,550,531 | A | 8/1996 | Little-Lowry | |
| 5,771,836 | A * | 6/1998 | Crouse | 116/209 |

FOREIGN PATENT DOCUMENTS

| | | | | |
|---|---|---|---|---|
| JP | 61018596 | A * | 1/1986 | B63H 21/22 |

* cited by examiner

*Primary Examiner*—R. Alexander Smith

(57) ABSTRACT

An automatic rising flag assembly includes a bracket connected to a water vessel and an elongated flagpole. The assembly further includes a mechanism connected to the water vessel and the bracket so that the flagpole can be pivoted and maintained between up and down positions. Such a mechanism includes a plurality of electrical contacts disposed at a ski handle and which send a signal to the mechanism while a skier has a grip around the electrical contacts. When a skier lets go of their grip, the signal is cancelled and causes the mechanism to release the flagpole upwardly for notifying others of the downed skier.

12 Claims, 4 Drawing Sheets

AUTOMATIC RISING CAUTION FLAG

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to flagpoles and, more particularly, to an assembly for automatically raising a marine caution flag.

2. Prior Art

With the ever-increasing popularity of water sports the number of water skiers has steadily increased, bringing ever larger numbers of water skiers and ski boats to a relatively fixed number of recreation areas. While water skiers are sufficiently visible while skiing to prevent all but the most careless of boating accidents, the sport presents one extremely dangerous situation, namely that of the downed water skier.

It will be recognized that even the most skilled of water skiers will occasionally fall, and that the norm of skill in the sport as displayed in recreational areas is far less, meaning that each ski boat is likely to have relatively frequent incidences in which the skier being towed from the boat is down. The relatively great speed of motor boats and the relatively poor visibility of a downed water skier in the water makes spotting a downed water skier a difficult task requiring concentration and a high degree of care. In most instances, the only visible indication of the presence of a downed water skier is a bobbing head in the water, and at least in some instances the water skier may be briefly under the water making the water skier extremely difficult to spot. A downed water skier struck by a boat is a potential fatality, due to the speed and force with which a boat is likely to strike the water skier, likely in the head, which is presented to the boat due to its location on the surface of the water.

A common precaution in the sport is the use of an observer seated in the stern of the ski boat, who may quickly signal the driver when the water skier falls and direct the driver to stop and return to the site where the water skier is floating. In fact, in many local jurisdictions, the presence of an observer is required by law. While the presence of an observer will ensure that the ski boat returns promptly to the site of a downed water skier, such an observer in not of great utility in warning other boats in the area that the water skier is down. The observer may attempt to wave off boats approaching the site of the downed water skier, but will in all likelihood not be heard or understood by operators of other boats due to normal noise level. The observer may inadvertently act as a distraction to operators of other boats, and may in fact increase the chance that these operators of other boats will not see the downed water skier.

One early attempt to present a warning to other boats in the area involved attaching a warning device to the water skier, to thereby give the water skier greater visibility when downed. Unfortunately, the only way such a device could be readily visible was if it was attached to the water skier's head. Needless to say, relatively few water skiers care to damage their image by wearing cumbersome paraphernalia on their heads. This strategy has therefore proved undesirable, and has never achieved great usage.

The signaling device that has shown the most promise is the warning flag or pennant, which is raised manually or otherwise when the water skier falls to warn operators of other boats that a downed water skier is in the vicinity. In fact, in areas under its jurisdiction, the United States Coast Guard has required that the ski boat display a warning flag indicating the presence of a water skier in the water following a fall or other incident. As with any rule of its type, adherence to this rule is directly proportional to the convenience of complying. If a flag is aboard and if it is convenient to do so, the observer or operator will display the flag. Otherwise, no warning signal is given to protect the downed water skier.

As might be expected, a better potential solution to the problem was shortly forthcoming in the form of both more convenient and automatic devices to deploy a warning flag from a ski boat when the water skier was down. By way of example, the former is illustrated in U.S. Pat. No. 4,122,796, to Pressler et al., which teaches a device in which a flag and pole is permanently mounted onto a ski boat at a location near the operator's position. The pole is movable between two locking positions, one a down position and the other an upright position. This device is a step in the right direction since it ensures that a flag is conveniently located near the operator; however, if the operator forgets to raise the flag, or deliberately does not raise it, there will be no warning flag displayed.

The other potential solution is even more desirable, in that devices which fall into the category designed to automatically raise a warning flag when the water skier is down in the water will be more likely to ensure that a warning flag is raised to indicate that the water skier is in the down position, in the water. These devices are essentially mechanical in nature, and have a spring means that acts to urge the flag into an upright position. The flag is retained a downward position by the tension of the ski rope, and when a water skier falls and drops the rope, the flag is raised. One shortcoming in this design, however, is that the rope often loses tension in turns or when vessel traffic or obstacles force the driver to slow down. In these situations, the flag could be raised unnecessarily.

Accordingly, a need remains for a device that automatically raises a caution flag when a water skier drops the rope.

BRIEF SUMMARY OF THE INVENTION

In view of the foregoing background, it is therefore an object of the present invention to provide a device for automatically raising a caution flag. These and other objects, features, and advantages of the invention are provided by an assembly including a bracket having an upper end portion and a lower end portion connected to a water vessel and an elongated flagpole having a lower end portion operably connected to the upper end portion of the bracket.

The assembly further includes a maintaining and controlling mechanism, operably connected to the bracket and a water vessel. Such a mechanism has a power supply source with a plurality of batteries housed in a waterproof container, which is electrically coupled to the mechanism for selectively maintaining the flagpole at a down position and for causing same to pivot upwardly about the upper end portion of the bracket. The maintaining and controlling mechanism includes an elongated shaft transversely passing through the lower portion of the flagpole and has opposed end portions disposed outwardly therefrom and secured to the bracket, respectively. The mechanism further includes a spring member positioned about the shaft at a tensed state when the flagpole is at a down position so that same is caused to pivot upwardly until the spring member reaches a relaxed state.

The maintaining and pivoting mechanism further includes a latch member having a first elongated arm with a first end portion fixedly connected to the bracket and a second end portion extending outwardly therefrom. The latch member includes a second elongated arm having a length less than the length of the first arm and having a first end portion pivotally connected to the second end portion of the first arm and further having a second end portion.

The latch member further includes a telescopic section including a mechanism for hydraulically moving same between up and down positions. The telescopic section includes a support member having a first end portion connected thereto and a second end portion having a substantially hook shape and being operably engageable with the second end portion of the second elongated arm for maintaining same at a predetermined position. The latch member further includes a locking member having a hooked lower end portion releasably engaged with the second end portion of the support member. The locking member disengages the support member when the telescopic section moves upwardly, thereby causing the second arm to pivot about the first end portion thereof.

The assembly further includes a ski handle electrically coupled to the telescopic section of the latch member. The ski handle includes a plurality of electrical contacts for causing a signal to be transmitted to the maintaining and pivoting mechanism and to thereby maintain the flag pole at a down position. When a user releases at least one of the plurality of electrical contacts, a signal is cancelled therefrom, and thereby causes the maintaining and pivoting mechanism to release the flagpole so that same can pivot upwardly from a down position.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
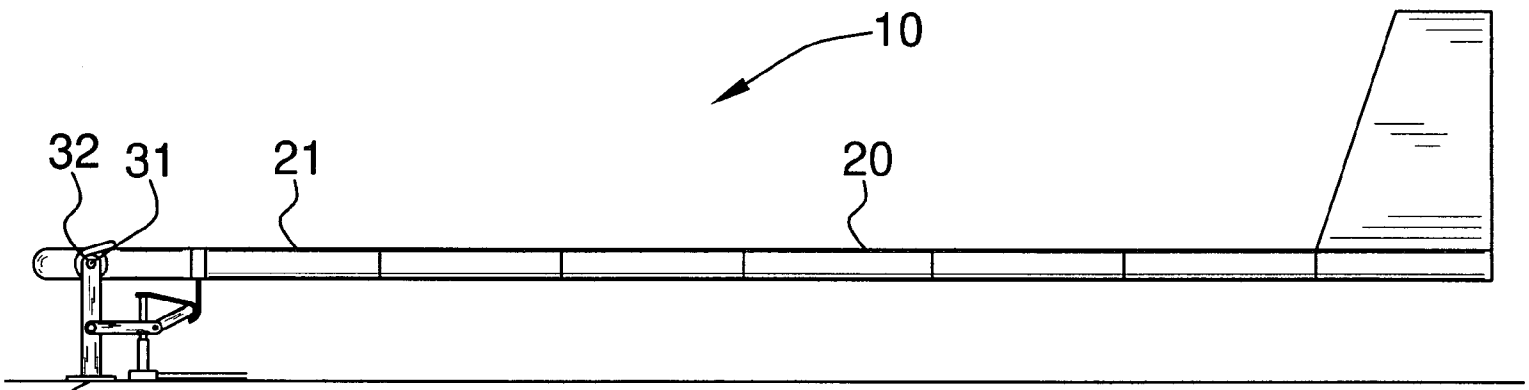
FIG. 1 is a side elevational view showing an automatic rising caution flag at the down position, in accordance with the present invention.
Figure 2:
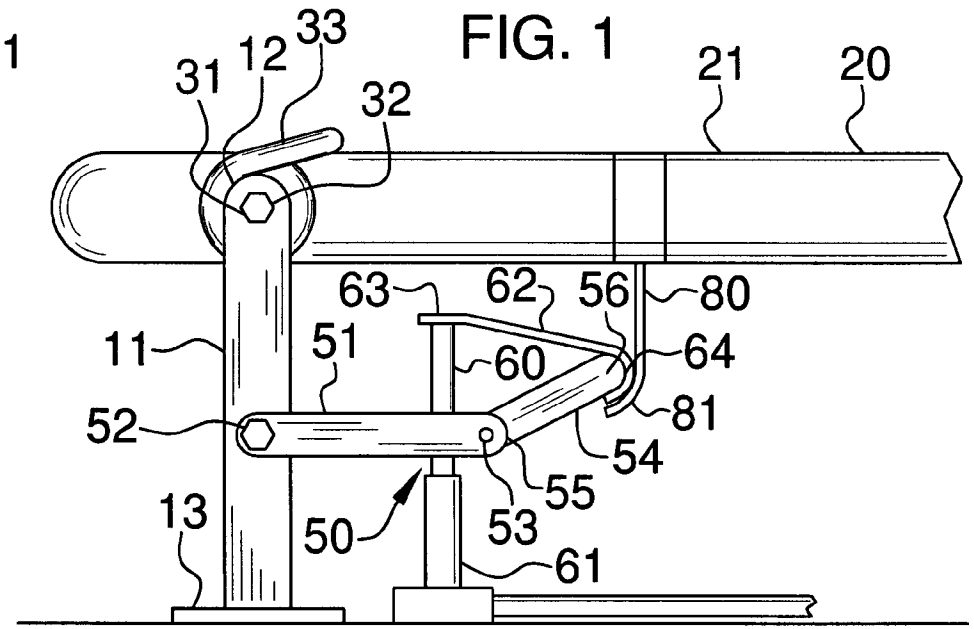
FIG. 2 is a partially enlarged view of FIG. 1.
Figure 3:
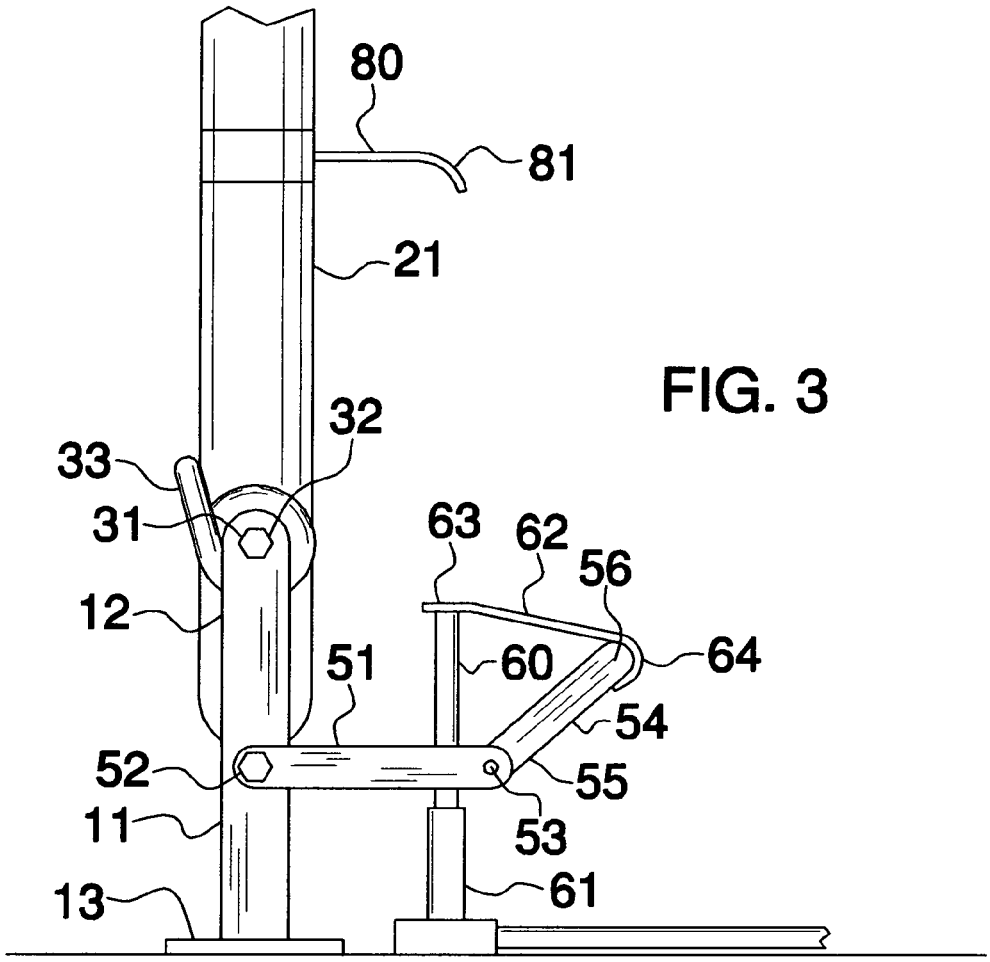
FIG. 3 is a partially enlarged view of FIG. 2 when the flag pole is at the up position.
Figure 4:
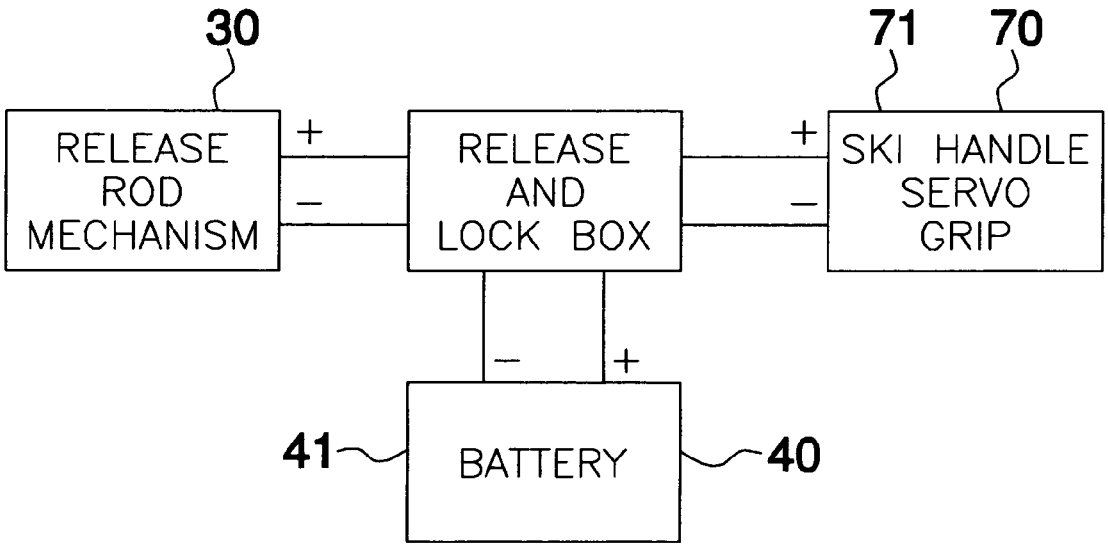
FIG. 4 is a schematic diagram of the power source and electrical system of the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

The assembly of this invention is referred to generally in FIGS. 1–4 by the reference numeral 10 and is intended to automatically raise a marine caution flag when a skier is down in the water. It should be understood that the assembly 10 may be used to raise many different types of objects and should not be limited to the raising of caution flags.

The assembly 10 includes a bracket 11 having an upper end portion 12 and a lower end portion 13 connected to a water vessel. The assembly further includes an elongated flagpole 20 having a lower end portion 21 operably connected to the upper end portion 12 of the bracket 11. The assembly 10 further includes a mechanism 30 operably connected to the bracket 11 and a water vessel. Such a mechanism has a power source 40 including a plurality of batteries (not shown) housed in a waterproof container 41 and for selectively maintaining the flagpole 20 at a down position whereby same may be caused to pivot upwardly about the upper end portion 12 of the bracket 11. The assembly 10 could also be powered by the water vessel's auxiliary power system, if available.

The maintaining and pivoting mechanism 30 includes an elongated shaft 31 transversely passing through the lower portion 21 of the flagpole 20 and has opposed end portions 32 disposed outwardly therefrom and secured to the bracket 11, respectively. The mechanism 30 further includes a spring member 33 positioned about the elongated shaft 31 and disposed at a tensed state when the flagpole is at a down position so that same is caused to pivot upwardly until the spring member 33 reaches a relaxed state. Advantageously, the spring member 33 automatically raises the caution flag quickly, and without the assistance of a spotter, enabling just two people, the driver and the skier, to recreate.

The maintaining and pivoting mechanism 30 further includes a latch member 50 including a first elongated arm 51 having a first end portion 52 fixedly connected to the bracket 11 and further having a second end portion 53 extending outwardly therefrom. The maintaining and pivoting mechanism 30 further includes a second elongated arm 54 with a length less than a length of the first arm 51 and having a first end portion 55 pivotally connected to the second end portion of the first arm 53 and further having a second end portion 56.

The latch member 50 further includes a telescopic section 60 including a mechanism 61 for hydraulically moving same between up and down positions. A support member 62 has a first end portion 63 connected to section 60 and a second end portion 64 having a substantially hook shape. Such a second end portion 64 is operably engaged with the second end portion 56 of the second arm 54 for maintaining same at a predetermined position. The latch member 50 further includes a locking member 80 having a hooked lower end portion 81 releasably engaged with the second end portion 64 of the support member 62, which disengages the support member 62 when the telescopic section 60 moves upwardly, to thereby cause the second arm 54 to pivot about the first end portion 62 thereof. While the assembly 10 could be formed from almost any metal, it is preferably formed from stainless steel because of its tendency to resist corrosion in a marine environment.

The assembly 10 further includes a ski handle 70, electrically coupled to the maintaining and pivoting mechanism 30. Such a ski handle 70 includes a plurality of electrical contacts 71 for causing a signal to be transmitted to the maintaining and pivoting mechanism 30 to assist in maintaining the flagpole at a down position. When a user releases at least one of the plurality of electrical contacts 71, a signal is cancelled therefrom, thereby causing the maintaining and pivoting mechanism 30 to release the flagpole so that same can pivot upwardly from a down position. Advantageously, because the user controls the electrical contacts, the flag is raised only when he/she releases one of the contacts and not when the rope loses tension. This prevents the flag from being raised in turns or other maneuvers which create slack in the rope, as noted in the above-referenced prior art.

Figure 5:
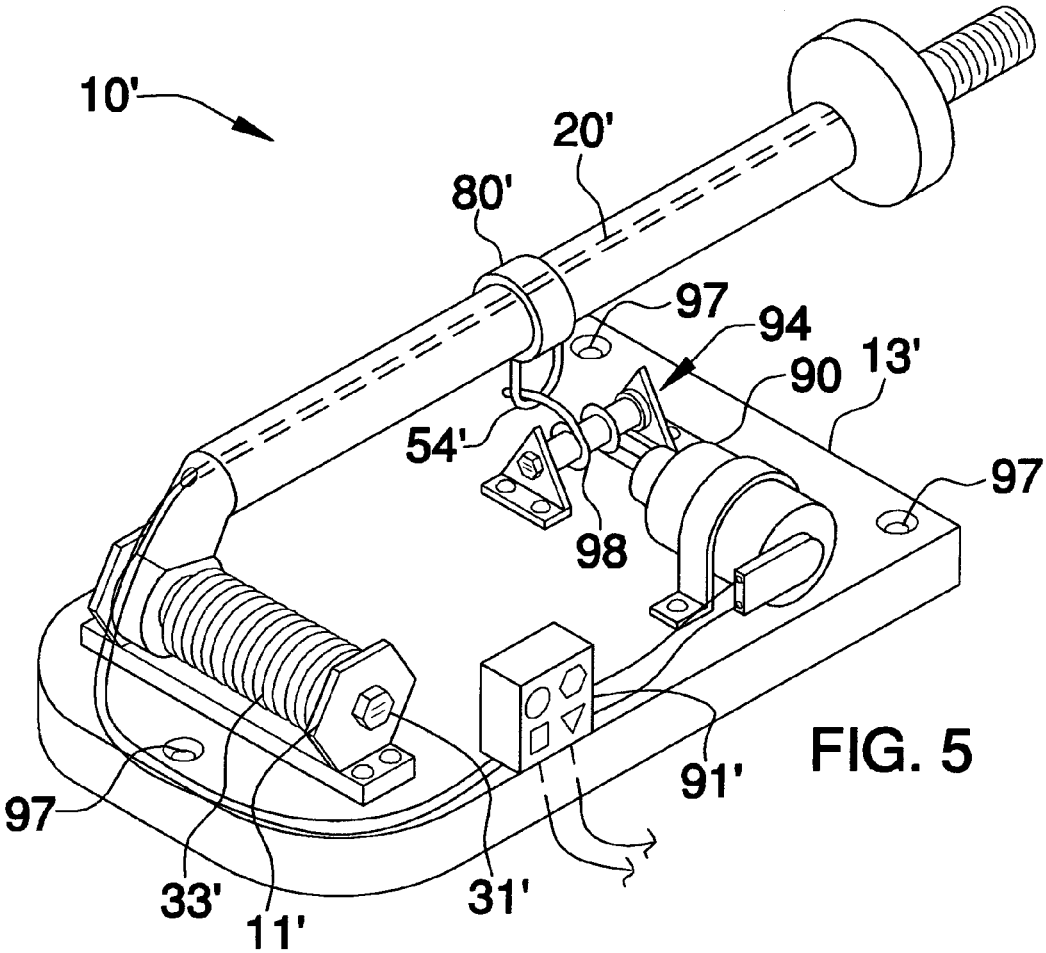
FIG. 5 is a perspective view showing an alternate embodiment of the present invention.
Figure 6:
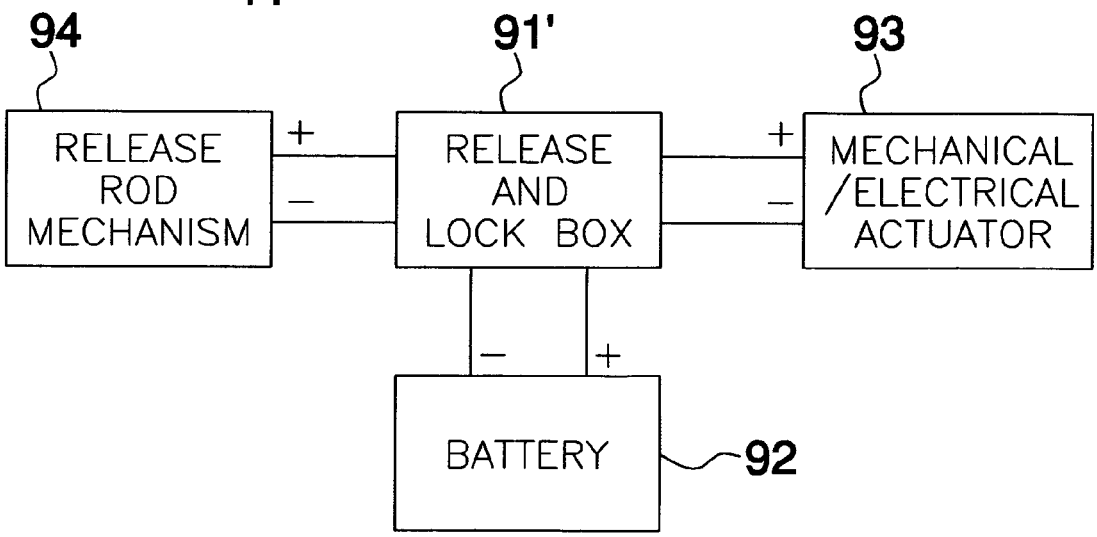
FIG. 6 is a schematic block showing the interrelationship between the major components of FIG. 5.
Figure 7:
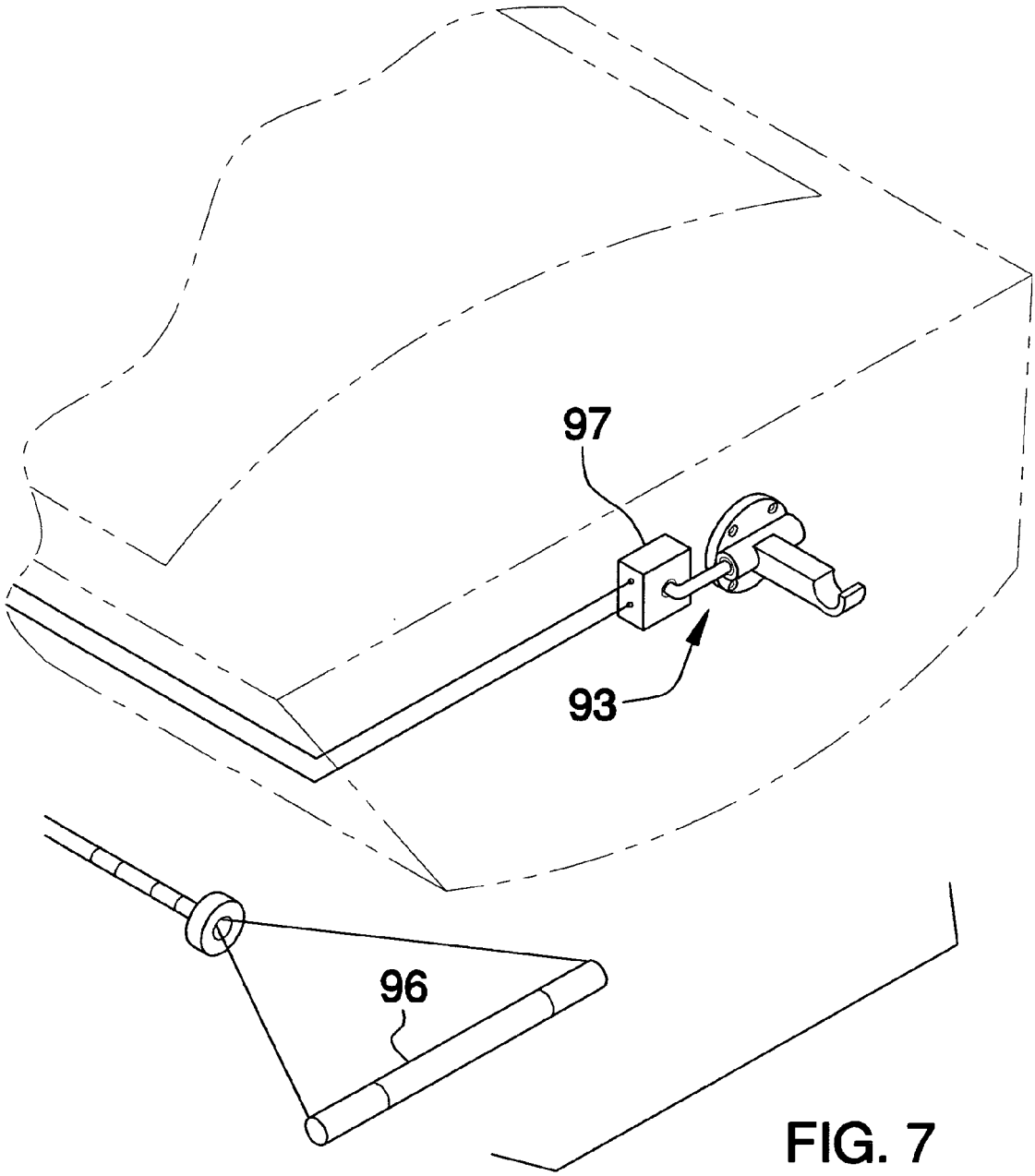
FIG. 7 is a perspective view showing a mechanical/electrical mechanism operably coupled to the ski handgrip and for generating/sending a signal to the release and lock box of the present embodiment.

Now referring to FIGS. 5–7, an alternate embodiment 10' of the present invention is shown as including a base member 13' having a substantially flat bottom surface provided with a plurality of apertures 97 for receiving a plurality of conventional fastening members (not shown) therethrough so that the base member 13' can be secured to a select portion of a water vehicle. An elongated flag pole 20' is pivotally connected to a distal end portion of the base member 13' and is movable between raised and lowered positions. In particular, a helical spring member 33' is operably connected to pole 20' and is caused to move to a relaxed position after pole 20' is released by release mechanism 94.

Such a mechanism 94 is caused to rotate about a selected axis and in respective opposing directions as the cylindrical shaft member 90 is extended and retracted based upon an input signal received from the release and lock box 91'. In particular, when a rider releases handle 96, a signal is generated and transmitted to control box 99 of mechanism 93 for directing lock box 91' to operate shaft member 90 between extended and retracted positions and thereby causing mechanism 94 to release or engage hook 98 connected to latch 54'.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A caution flag assembly comprising:

a bracket having an upper end portion and a lower end portion connected to a vehicle;

an elongated flagpole having a lower end portion operably connected to said upper end portion of said bracket;

means for selectively maintaining said flagpole at a down position and for causing same to pivot upwardly about said upper end portion of said bracket, said maintaining and pivoting means being operably connected to said bracket and the vehicle, said maintaining and pivoting means comprising:

a latch member including a first elongated arm having a first end portion fixedly connected to said bracket and further including a second end portion extending outwardly therefrom, and a second elongated arm having a first end portion pivotally connected to said second end portion of said first arm and further having a second end portion; and a telescopic section electrically coupled to said handle and including a support member having a first end portion connected thereto and a second end portion having a substantially hook shape, said second end portion of said support member being operably engaged with said second end portion of said second arm and for maintaining same at a predetermined position; and a locking member having a hooked lower end portion releasably engaged with said second end portion of said support member, said locking member being caused to disengage said support member when said telescopic section moves upwardly to thereby cause said second arm to pivot about said first end portion thereof after a user releases at least one of said electrical contacts on said handle;

a power supply source electrically coupled to said maintaining and pivoting means; and a ski handle including a plurality of electrical contacts for causing a signal to be transmitted to said maintaining and pivoting means and to thereby maintain said flag pole at the down position, when a user releases at least one of said plurality of electrical contacts a signal is cancelled therefrom to thereby cause said maintaining and pivoting means to release said flagpole so that same can pivot upwardly from the down position.

2. The assembly of claim 1, wherein said maintaining and pivoting means comprises:

rectilinear and elongated shaft transversely passing through said lower portion of said flagpole and having opposed end portions disposed outwardly therefrom and directly secured to said bracket respectively; and a spring member positioned about said shaft and being at a tensed state when said flagpole is at the down position so that said flagpole is caused to pivot upwardly until said spring member reaches a relaxed state.

3. The assembly of claim 1, wherein said second arm has a length that is less than a length of said first arm.

4. The assembly of claim 1, wherein said power supply source comprises a plurality of batteries housed in a waterproof container.

5. The assembly of claim 1, wherein said telescopic section includes means for hydraulically moving same between up and down positions.

6. A caution flag assembly comprising:

a bracket having an upper end portion and a lower end portion connected to a vehicle;

an elongated flagpole having a lower end portion operably connected to said upper end portion of said bracket;

means for selectively maintaining said flagpole at a down position and for causing same to pivot upwardly about said upper end portion of said bracket, said maintaining and pivoting means being operably connected to said bracket and the vehicle, said maintaining and pivoting means including an elongated shaft transversely passing through said lower portion of said flagpole and having opposed end portions disposed outwardly therefrom and secured to said bracket respectively, and a spring member positioned about said shaft and being at a tensed state when said flagpole is at the down position so that same is caused to pivot upwardly until said spring member reaches a relaxed state;

said maintaining and pivoting means further comprising:

a latch member including a first elongated arm having a first end portion fixedly connected to said bracket and further including a second end portion extending outwardly therefrom, and a second elongated arm having a first end portion pivotally connected to said second end portion of said first arm and further having a second end portion a telescopic section electrically coupled to said handle and including a support member having a first end portion connected thereto and a second end portion having a substantially hook shape, said second end portion of said support member being operably engaged with said second end portion of said second arm and for maintaining same at a predetermined position; and a locking member having a hooked lower end portion releasably engaged with said second end portion of said support member, said locking member being caused to disengage said support member when said telescopic section moves upwardly to thereby cause said second arm to pivot about said first end portion thereof after a user releases at least one of said electrical contacts on said handle;

a power supply source electrically coupled to said maintaining and pivoting means; and a ski handle including a plurality of electrical contacts for causing a signal to be transmitted to said maintaining and pivoting means and to thereby maintain said flag pole at the down position, when a user releases at least one of said plurality of electrical contacts a signal is cancelled therefrom to thereby cause said maintaining and pivoting means to release said flagpole so that same can pivot upwardly from the down position.

7. The assembly of claim 6, wherein said second arm has a length that is less than a length of said first arm.

8. The assembly of claim 6, wherein said power supply source comprises a plurality of batteries housed in a waterproof container.

9. The assembly of claim 6, wherein said telescopic section includes means for hydraulically moving same between up and down positions.

10. A caution flag assembly comprising:

a bracket having an upper end portion and a lower end portion connected to a vehicle;

an elongated flagpole having a lower end portion operably connected to said upper end portion of said bracket;

means for selectively maintaining said flagpole at a down position and for causing same to pivot upwardly about said upper end portion of said bracket, said maintaining and pivoting means being operably connected to said bracket and the vehicle, said maintaining and pivoting means including an elongated shaft transversely passing through said lower portion of said flagpole and having opposed end portions disposed outwardly therefrom and secured to said bracket respectively, a spring member positioned about said shaft and being at a tensed state when said flagpole is at the down position so that same is caused to pivot upwardly until said spring member reaches a relaxed state, a power supply source electrically coupled to said maintaining and pivoting means;

a ski handle including a plurality of electrical contacts for causing a signal, to be transmitted to said maintaining and pivoting means and to thereby maintain said flagpole at the down position, when a user releases at least one of said plurality of electrical contacts a signal is cancelled therefrom to thereby cause said maintaining and pivoting means to release said flagpole so that same can pivot upwardly from the down position, and a latch member including a first elongated arm having a first end portion fixedly connected to said bracket and further including a second end portion extending outwardly therefrom, and a second elongated arm having a first end portion pivotally connected to said second end portion of said first arm and further having a second end portion;

wherein said second arm has a length that is less than a length of said first arm;

a telescopic section electrically coupled to said handle and including a support member having a first end portion connected thereto and a second end portion having a substantially hook shape, said second end portion of said support member being operably engaged with said second end portion of said second arm and for maintaining same at a predetermined position; and a locking member having a hooked lower end portion releasably engaged with said second end portion of said support member, said locking member being caused to disengage said support member when said telescopic section moves upwardly to thereby cause said second arm to pivot about said first end portion thereof after a user releases at least one of said electrical contacts on said handle.

11. The assembly of claim 10, wherein said power supply source comprises a plurality of batteries housed in a waterproof container.

12. The assembly of claim 10, wherein said telescopic section includes means for hydraulically moving same between up and down positions.

* * * * *